US010238218B1

(12) United States Patent
Heilborn

(10) Patent No.: US 10,238,218 B1
(45) Date of Patent: Mar. 26, 2019

(54) PROTECTIVE COVER FOR FURNITURE

(71) Applicant: Furhaven Pet Products, Inc., Bellingham, WA (US)

(72) Inventor: Eric Heilborn, Bellingham, WA (US)

(73) Assignee: FURHAVEN PET PRODUCTS, INC., Bellingham, WA (US)

( * ) Notice: Subject to any disclaimer, the term of this patent is extended or adjusted under 35 U.S.C. 154(b) by 24 days.

(21) Appl. No.: 15/657,547

(22) Filed: Jul. 24, 2017

Related U.S. Application Data

(60) Provisional application No. 62/365,913, filed on Jul. 22, 2016.

(51) Int. Cl.
*A47C 31/02* (2006.01)
*A47C 31/11* (2006.01)

(52) U.S. Cl.
CPC ..... *A47C 31/11* (2013.01)

(58) Field of Classification Search
CPC ..... B60N 2/60; B60N 2/6018; B60N 2/58; B60N 2/6036; B60N 2/6009; A47C 31/10; A47C 31/11; A47C 27/008
See application file for complete search history.

(56) References Cited

U.S. PATENT DOCUMENTS 1,954,376 A * 4/1934 Brueckl ..... A47C 7/021 297/223
1,964,242 A * 6/1934 Behrle ..... B60N 2/60 297/223
2,109,652 A * 3/1938 Emmey ..... B60N 2/6027 24/72.5
2,383,687 A * 8/1945 Saltz ..... A47C 31/11 297/226
2,807,314 A * 9/1957 Larkin ..... B60N 2/6027 297/229
2,811,199 A * 10/1957 Morrill, Jr. ..... B60N 2/14 297/226
3,012,926 A 12/1961 Wintermute et al.
(Continued)

FOREIGN PATENT DOCUMENTS

WO 2013134968 A1 9/2013

OTHER PUBLICATIONS

Brittany Bailey, How to Slipcover a Couch Beautifully and UglySofa.com Giveaway, Aug. 24, 2011, 15 pages.
(Continued)

*Primary Examiner* — Shin H Kim
(74) *Attorney, Agent, or Firm* — Michael R. Schacht; Schacht Law Office, Inc.

(57) ABSTRACT

A cover assembly comprising a protective sheet and at least one anchor assembly. At least a portion of the protective sheet is folded to define a sheet edge. The anchor assembly comprises a connecting portion secured the sheet edge, an anchor member, an anchor strap secured to the anchor member, and a connector secured to the anchor strap. The anchor member is arranged in the bottom space. The anchor strap extends from the anchor member to an upper portion of the gap. The connector is detachably attached to the connecting portion to place the anchor assembly is in a connected configuration. The connector is detached from the connecting portion when the anchor assembly is in a disconnected configuration.

20 Claims, 1 Drawing Sheet

(56) References Cited

U.S. PATENT DOCUMENTS 3,185,523 A * 5/1965 Morrill, Jr. ..... B60N 2/7005 248/425
3,311,408 A * 3/1967 Sarvas ..... A47C 31/11 297/218.3
3,680,916 A 8/1972 Gilbert et al.
3,734,813 A 5/1973 Pohl
3,823,052 A 7/1974 Hargett
4,232,899 A * 11/1980 Fister, Jr. ..... A47C 31/023 297/229
D307,370 S * 4/1990 Bailey ..... D6/611
4,969,683 A * 11/1990 Wallace ..... B60N 2/6027 297/219.1
5,234,252 A 8/1993 Wallach
5,265,933 A 11/1993 Croshaw
5,494,330 A * 2/1996 Fotsch ..... A47C 31/11 297/219.1
5,518,292 A * 5/1996 Cozzani ..... A47C 31/023 24/301
5,636,897 A * 6/1997 Zapf ..... A47C 7/02 297/224
5,890,381 A 4/1999 Leeke et al.
5,957,528 A * 9/1999 Campbell ..... B60N 2/6036 297/218.4
6,478,382 B1 11/2002 Schulte
7,431,394 B2 10/2008 Neustat
7,607,732 B2 10/2009 Beroth et al.
7,677,662 B2 * 3/2010 Thompson ..... A47C 31/11 297/188.01
7,690,725 B1 4/2010 Rawlings
8,099,837 B2 1/2012 Santin et al.
8,393,675 B2 * 3/2013 Swanson ..... A47C 31/11 297/226
8,733,837 B2 5/2014 Weinstein et al.

OTHER PUBLICATIONS

Chelsea Katen Applby, Development of Fabric Seaming for Clothing Using Ultrasonic Sealing Technique, 2009, 21 pages.
Improvements Catalog, Microfiber Furniture Protector With Strap, Jul. 26, 2016, 6 pages.
James Dow, Improvements in and relating to Quilted Fabrics, Sep. 4, 1969, 4 pages, Intellectual Property Office, United Kingdom.
Montague Abraham Caplan, Chair, Jun. 4, 1958, 4 pages, Intellectual Property Office, United Kingdom.

* cited by examiner

PROTECTIVE COVER FOR FURNITURE

RELATED APPLICATIONS

This application, U.S. patent application Ser. No. 15/657,547 filed Jul. 24, 2017 claims benefit of U.S. Provisional Application Ser. No. 62/365,913 filed Jul. 22, 2016, now expired the contents of which are incorporated herein by reference.

TECHNICAL FIELD

The present invention relates to protective covers for furniture and, more specifically, to covers for furniture configured to prevent pets from damaging furniture.

BACKGROUND

Furniture can be expensive and difficult to clean. Spilled drinks, food particles, dirt, and the like can harm furniture materials. To reduce or eliminate damage to furniture, furniture may be covered with blankets, towels, or other sheet material. If the cover becomes soiled, the cover may be removed and washed.

Pets are of particular hard on furniture. Pets like to be near their owners. When an owner is sitting on furniture such as a couch or chair, the pet often wants to be on the furniture with the owner. And even when the owner is not sitting on the furniture, the pet will often occupy the furniture. Pets can be messy and unintentionally destructive to furniture. Pets shed hair, leave dirt, have accidents on, scratch, or otherwise damage furniture or make the furniture unattractive for use by people.

To facilitate removal of the furniture cover, furniture covers are typically laid on top of the seating and backrest surfaces. Pets and people getting on and off the furniture tend to move the cover, exposing the furniture underneath or behind and creating lumps that may be uncomfortable for both pets and people. Portions of the cover may be pushed into crevices or gaps between adjacent cushions and/or between cushions and the support surface (e.g., back) of the furniture, but movement of people and pets onto and off of the furniture can still dislodge the furniture cover.

The need thus exists for furniture covers that resist movement when pets and people get on and off furniture but still allow easy removal of the furniture cover for cleaning.

SUMMARY

The present invention may be embodied as a cover assembly for use with a piece of furniture comprising a seat portion and a support portion, where the seat portion and the support portion define a gap and a bottom space. The cover assembly comprises a protective sheet and at least one anchor assembly. At least a portion of the protective sheet is folded to define a sheet edge. The at least one anchor assembly comprises a connecting portion secured to the sheet edge, an anchor member, an anchor strap secured to the anchor member, and a connector secured to the anchor strap. The anchor member is arranged in the bottom space. The anchor strap extends from the anchor member to an upper portion of the gap. The connector is detachably attached to the connecting portion to place the anchor assembly in a connected configuration. The connector is detached from the connecting portion when the anchor assembly is in a disconnected configuration. At least a portion of the protective sheet is held in place relative to the piece of furniture when the anchor assembly is in the disconnected configuration. The protective sheet may be removed from the furniture when the anchor assembly is in the disconnected configuration.

The present invention may also be embodied as a method of covering at least a portion of a piece of furniture comprising a seat portion and a support portion, where the seat portion and the support portion define a gap and a bottom space, the method comprising the following steps. At least a portion of a protective sheet is folded to define a sheet edge. At least one anchor assembly is provided, where the at least one anchor assembly comprises a connecting portion, an anchor member, an anchor strap secured to the anchor member, and a connector secured to the anchor strap. The connecting portion is secured to the sheet edge. The anchor member is inserted through the gap and into the bottom space such that the anchor strap extends from the anchor member to an upper portion of the gap. The connector is detachably attached to the connecting portion to place the anchor assembly in a connected configuration, where at least a portion of the protective sheet is held in place relative to the piece of furniture when the anchor assembly is in the disconnected configuration. The connector is detached from the connecting portion to place the anchor assembly in a disconnected configuration. The protective sheet is removed from the furniture when the anchor assembly is in the disconnected configuration.

The present invention may also be embodied as a cover assembly for use with a piece of furniture comprising a seat portion and a support portion, where the seat portion and the support portion define a gap and a bottom space. The cover assembly comprises a protective sheet and at least one anchor assembly. At least a portion of the protective sheet is folded to define a sheet edge. The at least one anchor assembly comprises a connecting portion secured to the sheet edge, an anchor member, where the anchor member is resilient deformable and defines a volume of a first size when in an undeformed state, an anchor strap secured to the anchor member, where the anchor strap is resiliently deformable, and a connector secured to the anchor strap. The anchor member is passed through the gap by deforming the anchor member such that the volume of the anchor member is a second size, where the second size is less than the first size. When the anchor member is arranged in the bottom space, the anchor member is allowed to expand such that the volume of the anchor member is a second size, where the second size is greater than the first size. The anchor strap extends from the anchor member to an upper portion of the gap. The connector is detachably attached to the connecting portion to place the anchor assembly in a connected configuration. The connector is detached from the connecting portion when the anchor assembly is in a disconnected configuration. At least a portion of the protective sheet is held in place relative to the piece of furniture when the anchor assembly is in the disconnected configuration. The protective sheet may be removed from the furniture when the anchor assembly is in the disconnected configuration.

DETAILED DESCRIPTION

Figure 1:
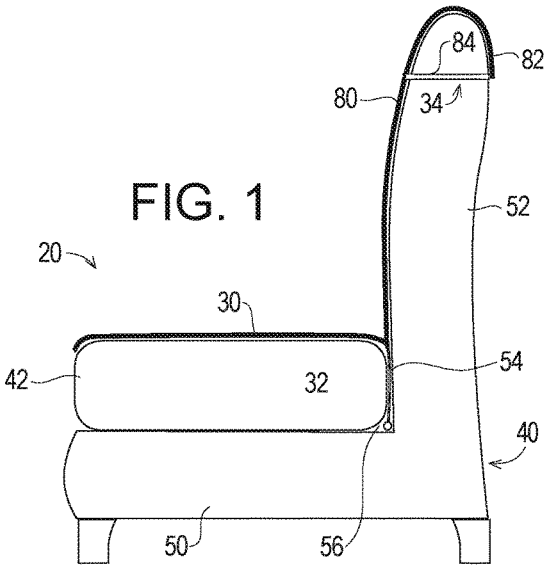
FIG. 1 is a side elevation view depicting a chair or couch being protected by a pet cover of the present invention.

Referring initially to FIG. 1, depicted therein is a cover assembly 20 used to cover at least a portion of a piece of furniture 22 such as a chair or couch. The example cover assembly 20 comprises a protective sheet 30, an anchor assembly 32, and, optionally, a support strap assembly 34.

The example piece of furniture 22 defines a main structure 40 and a cushion 42. The main structure 40 defines a seat portion 50 and a support portion 52. The cushion 42 rests on the seat portion 50 and against the support portion 52. A cushion gap 54 is defined between the cushion 42 and the support portion 52. A bottom space 56 is defined between the cushion 42 and the main structure 40 at the intersection of the seat portion 50 and the support portion 52.

With the cushion 42 resting on the seat portion 50 and against the support portion 52, the protective sheet 30 is sized and dimensioned to extend over at least a portion of the cushion 42 and at least a portion of the support portion 52. So arranged, the protective sheet 30 is folded to define a sheet edge 60. When supported by the piece of furniture 22, the protective sheet 30 is arranged such that sheet edge 60 is immediately adjacent to and extends along at least a portion of the cushion gap 54.

Figure 1A:
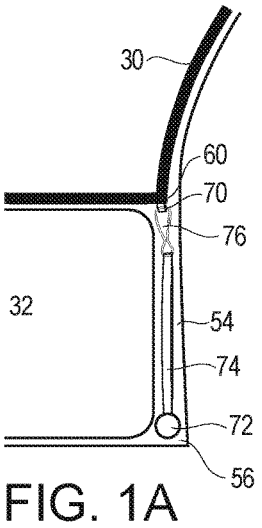
FIG. 1A is a side elevation view depicting an anchor system used to secure a portion of the pet cover to the chair or couch.

FIG. 1A illustrates that the example anchor assembly 32 comprises at least one anchor loop 70 secured to the sheet edge 60 of the protective sheet 30, at least one anchor member 72, at least one anchor strap 74 secured to the at least one anchor member 72, and at least one anchor clip 76 attached to each anchor strap 74. The example clip member (s) 76 is (are) configured to detachably attach the anchor strap(s) 74 to the anchor loop(s) 70. In use, the anchor member 72 is arranged within the bottom space 56 and the anchor clip(s) 76 are connected to the anchor loop(s) such that the anchor member 72 inhibits movement of the sheet edge 60 away from the top of the cushion gap 54.

More specifically, the anchor member 72 is forced into the cushion gap 54 between the cushion 42 and the support portion 52. The example anchor member 72 is resiliently deformable such that a volume of the anchor member 72 is minimized as it is forced through the cushion gap 54. Eventually, the anchor member 72 is forced into the bottom space 56. The volume of the bottom space 56 is typically more generous than a cross-sectional area of the cushion gap 54, so the anchor member 72 may expand slightly when it reaches the bottom space 56. The increase in volume of the anchor member 72 when in the bottom space 56 positively holds the anchor member 72 within the bottom space 56 and resists movement of the anchor member 72 up out of the bottom space 56 through the cushion gap 54.

The example anchor member 72 thus exists in an undeformed state in which a volume of the anchor member 72 is maximized. The example anchor member 72 may be arranged in a continuum of compressed states in which the volume of the anchor member 72 is less than the volume of the anchor member 72 in the undeformed state. Typically, the volume of the anchor member 72 is a first size in an undeformed state. The volume of the anchor member 72 is reduced to a second size when the anchor member 72 is passed through the cushion gap 54. The volume of the anchor member 72 increases from the second size to a third size when the anchor member 72 is in the bottom space 56. The second size is thus less than the first and third sizes, and the third size is less than or equal to the first size. The example anchor member 72 is or may be or comprise an elongate foam structure. The foam structure may be arranged within a jacket to facilitate attachment of the anchor strap 74 to the anchor member 72. The example foam structure 74 is cylindrical or a rectangular solid.

The example anchor strap(s) 74 are resiliently deformable to allow an effective length thereof to be changed by applying a tension force along a longitudinal axis A thereof. Accordingly, the anchor strap(s) 74 typically exerts a tension force on the sheet edge 60 such that the sheet edge 60 is securely held adjacent to an upper portion of the cushion gap 54.

The anchor strap(s) 74 may be rigidly connected directly to the sheet edge 60. The use of the example anchor loop(s) 70 and example clip member(s) 76 allow the anchor strap(s) 74 to be detachably attached from the sheet edge 60 for removal of the protective sheet 30. The example anchor loops 70 thus form a connecting portion to facilitate attachment of the clip member(s) 76 to the sheet edge 60. The example clip member(s) 76 thus form a connector to facilitate attachment of the anchor strap(s) 74 to the anchor loop(s) 70.

Connecting portions other than the anchor loop(s) 70 and connectors other than the clip member(s) 76 may be used to secure the anchor strap(s) 74 to the sheet edge 60. For example, the connecting portion and connector may be formed by a button and button hole, a snap button, a hook and loop fastener, a snap buckle, or any other structure or assembly capable of holding the sheet edge 60 in place but allowing quick removal of the sheet protective sheet 30 from the piece of furniture 22.

Further the example anchor strap(s) 74 may be formed by any elongate member capable of holding the sheet edge 60 in place. As examples, the anchor strap(s) 74 may be formed by webbing, cords, string, wires, or the like of sufficient strength and durability to perform the functions described herein. To facilitate the establishment of tension that holds the sheet edge 60 in place, the anchor strap(s) 74 may be provided with a resilient component such as elastic threads, bands, or cords. For example, resilient straps, cords, tapes, and the like may be used as the anchor strap(s) 74 to apply tension to the sheet edge 60.

Figure 2:
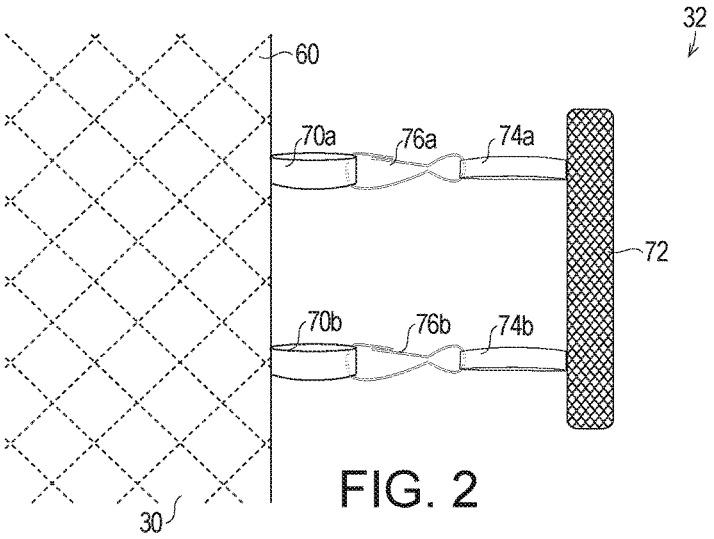
FIG. 2 is a top plan view illustrating an example anchor system of the present invention.

FIG. 2 illustrates that the example anchor assembly 32 comprises first and second anchor loops 70*a* and 70*b*, a single anchor member 72, first and second anchor straps 74*a* and 74*b*, and first and second anchor clips 76*a* and 76*b*. An anchor member 72 may be connected to each anchor loop 70, or more than two anchor loops 70, anchor straps 74, anchor clips 76 may be used with a single anchor member 72.

The example support strap assembly 34 may be used to inhibit movement of an upper portion 80 of the protective sheet 30 away from the support portion 52 of the main structure 40. In particular, one or more support straps 84 may be arranged to extend around a side of the support portion 52 and connected to a rear portion 82 of the protective sheet 30 or to the opposite side of the upper portion 80 of the protective sheet 30.

The example piece of furniture 22 is shown by way of example only and is not per se part of the present invention. The cover assembly 20 of the present invention may be used with other furniture sizes, types, proportions, and styles.

Further, the support portion 52 may take the form of either a seat back as shown in FIGS. 1 and 2 or of an armrest that engages the side instead of the back of a person sitting on the couch. If the piece of furniture 22 comprises an armrest defining the support portion 52, one or more anchor assemblies 32 may be arranged within the gap 54 defined by the armrest forming the support portion 52 to secure a side edge of the protective sheet 30 against the gap formed by the seat portion 50 and the armrest forming the support portion 52.

What is claimed is:

1. A cover assembly for use with a piece of furniture comprising a seat portion and a support portion, where the seat portion and the support portion define a gap and a bottom space, the cover assembly comprising:

a protective sheet, where at least a portion of the protective sheet is folded to define a sheet edge; and at least one anchor assembly comprising a connecting portion secured the sheet edge, an anchor member, an anchor strap secured to the anchor member, and a connector secured to the anchor strap; whereby the anchor member is arranged in the bottom space;

the anchor strap extends from the anchor member to an upper portion of the gap;

the connector is detachably attached to the connecting portion to place the anchor assembly is in a connected configuration;

the connector is detached from the connecting portion when the anchor assembly is in a disconnected configuration;

at least a portion of the protective sheet held in place relative to the piece of furniture when the anchor assembly is in the disconnected configuration; and the protective sheet may be removed from the furniture when the anchor assembly is in the disconnected configuration.

2. A cover assembly as recited in claim 1, in which the anchor member is resiliently deformable.

3. A cover assembly as recited in claim 2, in which:

a volume of the anchor member is a first size in an undeformed state;

the volume of the anchor member is reduced from the first size to a second size to allow the anchor member to be inserted through the gap; and the volume of the anchor member is increased from the second size to a third size when the anchor member is within the bottom space.

4. A cover assembly as recited in claim 3, in which the third size is less than or equal to the first size.

5. A cover assembly as recited in claim 3, in which:

the third size is greater than the second size; and the third size is less than or equal to the first size.

6. A cover assembly as recited in claim 1, in which the anchor member comprises a foam structure.

7. A cover assembly as recited in claim 1, in which the anchor strap is resiliently deformable.

8. A cover assembly as recited in claim 1, further comprising at least one support strap assembly configured to support at least a portion of the protective sheet relative to the support portion.

9. A cover assembly as recited in claim 8, in which the at least one support strap assembly comprises at least one support strap configured to extend around at least a portion of the support portion.

10. A method of covering at least a portion of a piece of furniture comprising a seat portion and a support portion, where the seat portion and the support portion define a gap and a bottom space, the method comprising the steps of:

folding at least a portion of a protective sheet to define a sheet edge; and providing at least one anchor assembly comprising a connecting portion, an anchor member, an anchor strap secured to the anchor member, and a connector secured to the anchor strap; whereby securing the connecting portion to the sheet edge;

inserting the anchor member through the gap and into the bottom space such that the anchor strap extends from the anchor member to an upper portion of the gap;

detachably attaching the connector to the connecting portion to place the anchor assembly in a connected configuration, where at least a portion of the protective sheet is held in place relative to the piece of furniture when the anchor assembly is in the disconnected configuration;

detaching the connector from the connecting portion to place the anchor assembly in a disconnected configuration; and removing the protective sheet from the furniture when the anchor assembly is in the disconnected configuration.

11. A method as recited in claim 10, in which the step of providing at least one anchor assembly comprises the step of providing a resiliently deformable anchor member.

12. A method as recited in claim 11, in which:

a volume of the anchor member is a first size in an undeformed state; and the step of inserting the anchor member through the gap and into the bottom space comprises the steps of reducing the volume of the anchor member from the first size to a second size to allow the anchor member to be inserted through the gap; and allowing the volume of the anchor member to increase from the second size to a third size when the anchor member is within the bottom space.

13. A method as recited in claim 12, in which the third size is less than or equal to the first size.

14. A method as recited in claim 12, in which:

the third size is greater than the second size; and the third size is less than or equal to the first size.

15. A method as recited in claim 10, further comprising the step of resiliently deforming the anchor strap.

16. A method as recited in claim 10, further comprising the step of supporting at least a portion of the protective sheet relative to the support portion.

17. A method as recited in claim 16, in which the step of supporting at least a portion of the protective sheet relative to the support portion comprises the step of extending at least one support strap around at least a portion of the support portion.

18. A cover assembly for use with a piece of furniture comprising a seat portion and a support portion, where the seat portion and the support portion define a gap and a bottom space, the cover assembly comprising:

a protective sheet, where at least a portion of the protective sheet is folded to define a sheet edge; and at least one anchor assembly comprising a connecting portion secured the sheet edge, an anchor member, where the anchor member is resilient deformable, and defines a volume of a first size when in an undeformed state, an anchor strap secured to the anchor member, where the anchor strap is resiliently deformable, and a connector secured to the anchor strap; whereby the anchor member is passed through the gap by deforming the anchor member such that the volume of the anchor member is a second size, where the second size is less than the first size;

when the anchor member is arranged in the bottom space, allowing the anchor member to expand such that the volume of the anchor member is a second size, where the second size is greater than the first size;

the anchor strap extends from the anchor member to an upper portion of the gap;

the connector is detachably attached to the connecting portion to place the anchor assembly is in a connected configuration;

the connector is detached from the connecting portion when the anchor assembly is in a disconnected configuration;

at least a portion of the protective sheet held in place relative to the piece of furniture when the anchor assembly is in the disconnected configuration; and the protective sheet may be removed from the furniture when the anchor assembly is in the disconnected configuration.

19. A cover assembly as recited in claim 18, in which the third size is less than or equal to the first size.

20. A cover assembly as recited in claim 17, further comprising at least one support strap assembly configured to support at least a portion of the protective sheet relative to the support portion.

* * * * *